United States Patent [19]

Balfour

[11] 4,226,418

[45] Oct. 7, 1980

[54] GAME RACKET HAND GRIP

[76] Inventor: Ronald S. Balfour, 1061 Beach Park Blvd.,, #309 Foster City, Calif. 94404

[21] Appl. No.: 962,379

[22] Filed: Nov. 20, 1978

[51] Int. Cl.[3] ..... A63B 49/08

[52] U.S. Cl. ..... 273/75; D21/212

[58] Field of Search ..... 273/75, 73 R, 73 J, 273/77 R, 81 R, 81.2, 81.3, 81.4, 81.5, 81.6, 165, 76; D21/212, 213, 222

[56] References Cited

U.S. PATENT DOCUMENTS

| | | | |
|---|---|---|---|
| 472,006 | 3/1892 | Walker et al. | 273/81.4 X |
| 855,016 | 5/1907 | Orthwein | 273/165 |
| 1,587,287 | 6/1926 | Denman | 273/165 |
| 2,710,190 | 6/1955 | Schimansky | 273/81.4 X |
| 3,203,697 | 8/1965 | Berzatzy | 273/75 |
| 3,227,455 | 1/1966 | Hulsman | 273/81.2 X |
| 3,674,268 | 7/1972 | Shellman, Sr. | 273/76 |

FOREIGN PATENT DOCUMENTS

| | | | |
|---|---|---|---|
| 2220289 | 10/1974 | France | 273/75 |

*Primary Examiner*—John D. Yasko
*Attorney, Agent, or Firm*—Harris Zimmerman

[57] ABSTRACT

A hand grip for a game racket having a head and a handle extending therefrom includes a tubular member secured coaxially to the distal end of the handle. Extending radially from the tubular member is a narrow web portion which includes four finger holes extending generally orthogonally therethrough. The exterior surface of the tubular member includes recessed portions and textured surface portions to receive the thumb and palm of the hand engaging the finger holes. In one embodiment, the web portion extends axially and includes serial finger slots to receive the fingers of the other hand of the racket user.

8 Claims, 5 Drawing Figures

GAME RACKET HAND GRIP

BACKGROUND OF THE INVENTION

In the field of rackets used for sports such as tennis, racket ball, squash, and the like, the handle of the racket has traditionally been shaped as a cylindrical, oval, rectangular, or octagonal tubular member which is dimensioned to be gripped easily by the racket user. Many individuals have found, however, that these prior art handle constructions are unsatisfactory in several different respects.

The prior art handle assemblies provide little tactile indication of the orientation of the face of the racket. Obviously a small error in the tactially perceived angle of the racket head can produce a large error in the trajectory of the ball which is struck by the racket.

Also, racket handles are know to become slippery during use, due to the perspiration which is absorbed from the hand of the racket user. As the handle becomes more slippery with prespiration, the player must grip the handle more tightly to carry the racket during play as well as to swing the racket to strike the ball. This in turn may lead to fatigue of the hand of the player and ultimately to deterioration of the quality of the play.

Attempts have been made in the prior art to modify the handle structure of game rackets to overcome these problems. The following United States Patents comprise the closest known prior art:

U.S. Pat. No. 3,817,521
U.S. Pat. No. 3,868,110
U.S. Pat. No. 3,905,598
U.S. Pat. No. 4,006,896
U.S. Pat. No. 4,072,311

Generally speaking, the modifications of the handle structure in the prior art comprise finger grooves which are formed in the handle member to receive the fingers and thumb of the hand of the player. Although the finger grooves may increase the frictional engagement with the hand of the player, they do not necessarily increase the tactile perception of the angle of the face of the racket. Furthermore, the finger receiving grooves have depth and spacing corresponding to a particular hand size. For different sized hands, corresponding sizes of hand grips must be produced. The multiplicity of sizes and configurations prevents the profitable distribution of these forms of handle members.

This problem is further exacerbated by the fact that grooves formed in the handle member to receive the thumb and fingers of the hand of the player must be configured as right or left hand models, as it is impossible for the fingers of the left hand to fit into grooves provided for a right handed person, and visa versa. Thus the number of models of grooved hand grips must be doubled.

Also, it should be noted that in some racket sports like tennis, most individuals change their grip on the racket for backhand and forehand strokes. Indeed, many of the grooved handles known in the prior art are adapted to accommodate such a shift in the grip of the player. However, many players change their grip on the racket much more markedly; i.e., from a western grip to a continental grip to effect top spin, under spin, or the like. A grooved handle construction may actually impede this extreme shift playing style and technique.

SUMMARY OF THE PRESENT INVENTION

The present invention generally comprises a hand grip for game rackets such as tennis rackets, squash rackets, and the like. The hand grip is characterized by an increased tactile perception of the angle of the face of the racket, as well as a nonslip grip construction which permits the racket to be carried without being tightly grasped.

The hand grip of the present invention includes a tubular member which is adapted to be secured to the distal end portion of a racket handle. The tubular member may be ovoid, cylindrical, or provided with a plurality of longitudinally extending planar facets. A narrow web portion extends radially from the tubular member, and is provided with four adjacent finger holes extending generally orthogonally therethrough. The fingers of the hand grasping the racket extending through the finger holes, and the surface of the tubular member adjacent to the web portion is provided with recessed, textured surface portions which receive the thumb and palm of the hand. The engagement of the fingers in the finger holes of the web provides a secure grip which cannot slip. The angular alignment of the web portion with the face of the racket is fixed, and the tactile perception of the web portion provides an exact indication of the orientation of the face of the racket.

In one embodiment of the present invention, the tubular member is extended toward the racket head, and the web portion is likewise extended in the axial direction. The extended web portion is provided with a plurality of adjacent finger slots which are provided to be engaged by the other hand of the player. This construction facilitates two handed racket strokes, such as the two handed backhand stroke which has become popular recently. The extended portion of the tubular member is also provided with a textured surface to increase the frictional engagement thereof.

A BRIEF DESCRIPTION OF THE DRAWING

DESCRIPTION OF THE PREFERRED EMBODIMENT

Figure 1:
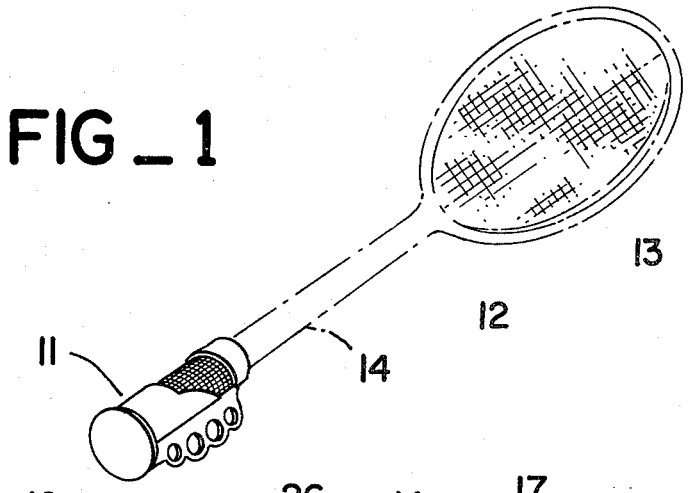
FIG. 1 is a perspective view of a tennis racket employing the hand grip of the present invention.

As shown in FIG. 1, the present invention generally comprises a hand grip 11 for use in conjunction with a game racket 12 which includes a generally planar head 13 and a handle 14 extending therefrom. The racket 12 may comprise a tennis racket, squash racket, or the like.

Figure 2:
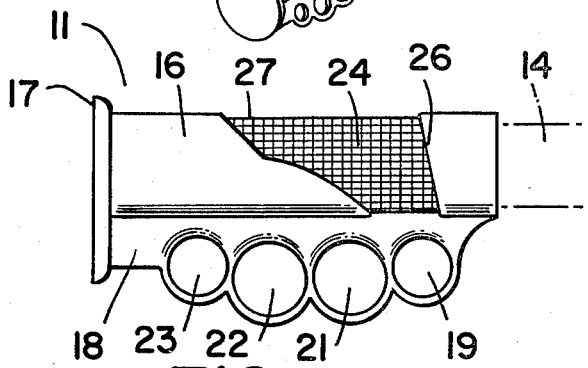
FIG. 2 is a plan view of the hand grip of the present invention.
Figure 3:
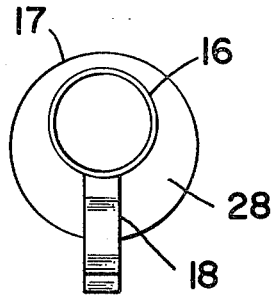
FIG. 3 is an end view of the invention as shown in FIG. 2.

With reference to FIGS. 2 and 3, the hand grip 11 includes a tubular member 16 which is secured about the distal end portion of the handle 14 of the racket. The tubular member 16 is depicted as having a generally cylindrical cross-sectional nature, although it may be appreciated that the member 16 may be provided with an ovoid configuration or a plurality of longitudinally extending planar facets. It should be noted that the tubular member 16 is aligned coaxially with the handle 14 of the racket.

Extending generally radially from the tubular member 16 is a web member 18 which extends longitudinally the length of the tubular member 16. A quartet of holes 19, 21, 22, and 23 extend generally orthogonally through the web member 18, the holes being spaced closely together in adjacent relationship. It should be noted that the holes 19 and 23 are equal in diameter, and are adapted to receive the index finger and the fourth finger of the hand gripping the hand grip 11. The holes 21 and 22 are equal in diameter and larger than the holes 19 and 23, in order that they may accommodate the second and third fingers of the hand.

The edge portions of the holes 19, 21–23 which are adjacent to the tubular member 16 are provided with a bevel to accept the fingers of the hand extending therethrough in oblique fashion, as in a natural, closed grip. A portion 24 of the surface of the tubular member is recessed and is provided with a textured finish to enhance frictional engagement therewith. The forward edge 26 of the portion 24 is generally aligned with the proximal edge of the hole 19 in the web 18. The distal edge 27 of the portion 24 extends obliquely and distally from a junction with the web portion 18 which is generally adjacent to the proximal edge of the hole 21. The recess portion 24 is provided to receive the thumb of the hand of the racket user, as well as the palm portion of the hand, which is accommodated by the longest axially extending part of the portion 24.

It should be noted that the holes 19, 21–23 are adapted to receive the fingers of the right hand or left hand. Likewise, the recessed portion 24 will receive the thumb and palm area of either the right or left hand. Thus a single model of the hand grip 11 of the present invention may accommodate either left or right hand players.

Joined to the distal end of the tubular member 16 is a heel stop plate 17. The heel stop plate generally comprises a cylindrical disc which is slightly larger in diameter than the distance equal to the sum of the diameter of the tubular member 16 and the width of the web portion 18. The plate 17 is offset eccentrically from the axis of the tubular member 16 in the same direction as the radial extent of the web portion 18. As shown in FIG. 3, the heel stop plate provides a substantial surface area 28 to engage the heel of the hand of the user and to provide a firm rest therefore.

It should be noted that in the preferred embodiment the radially distal edge of the web portion 18 is scalloped to be concentric about portions of the holes 19, and 21–23. However, it is within the scope of the invention to provide a smooth curving edge of the web portion 18.

It may be appreciated that with the four fingers of a hand engaging the finger holes 19 and 21–23 the racket 12 easily may be retained and manipulated. Furthermore, little muscular effort is required of the hand of the player to retain control of the racket, due to the engagement of the fingers in the finger holes. The secure retention of the racket will aid in certain racket strokes, such as the overhead stroke or the serve, in that little muscular effort is required to retain and control the racket, so that a maximum amount of muscular effort can be directed toward snapping the wrisk as the racket is translated to strike the ball.

Figure 4:
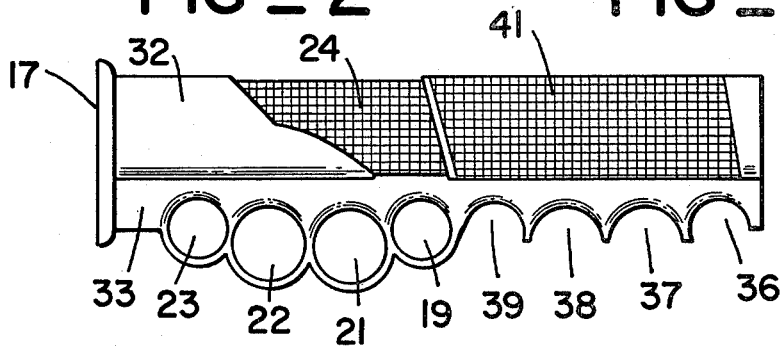
FIG. 4 is a plan view of an alternative embodiment of the present invention.
Figure 5:
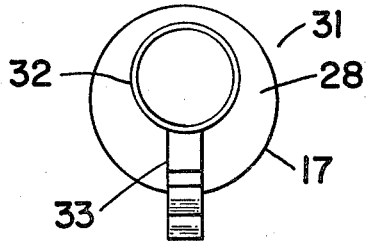
FIG. 5 is an end view of the invention as shown in FIG. 4.

A further embodiment of the present invention is shown in FIGS. 4 and 5. This embodiment includes a hand grip 31 which includes a tubular member 32 aligned coaxially with the handle 14 of the racket and secured to the distal end thereof. In this embodiment, the tubular member 32 is approximately twice as long as the tubular member 16 of the previous embodiment. Likewise, the web portion 33 which extends radially outwardly from the tubular member 32 extends the entire length of the tubular member. The finger holes 19 and 21–23 are provided as before, as is the heel stop plate 17 at the distal end of the grip 31.

A salient feature of the further embodiment is a provision of a quartet of adjacent, generally arcuate slots 36, 37, 38, and 39 in the radially distal edge of the web portion 33. The slots 36–39 are provided to receive portions of the fingers of the second hand of the player, assuming that the first hand is engaging the finger holes 19 and 21–23, as well as the textured recessed portion 24 of the grip. Thus the embodiment of FIGS. 4 and 5 accommodates the style of play in which forehand and backhand shots are accomplished using two hands to grasp and control the racket 12. The portion of the tubular member 32 which is adjacent to the finger slots 36–39 is also provided with a textured exterior surface 41 which provides frictional engagement for the palm and thumb portions of the hand which engages the finger slots.

As noted in the foregoing, the embodiment of FIGS. 4 and 5 may be employed by either right or left handed persons with equal facility and advantage. Furthermore, the tubular member 32, although shown in FIG. 5 as having a generally cylindrical nature, may be provided with rectangular or octagonal facets to increase the comfort of the hand grip 31.

I claim:

1. In a game racket which includes a racket head and a handle extending therefrom; a hand grip comprising a tubular member secured to the distal end of said handle in axial alignment therewith, a rigid web portion extending generally radially from said tubular member and extending longitudinally therealong, a plurality of finger receiving holes extending through said web portion and spaced longitudinally in closely adjacent fashion, said holes being variably radially spaced from the axis of said tubular member.

2. The hand grip of claim 1, further including a heel stop plate secured to the distal end of said tubular member and extending generally radially therefrom to engage the heel and outer edge portions of a hand grasping said hand grip.

3. The hand grip of claim 1, wherein said finger holes extend generally orthogonally through said web portions.

4. The hand grip of claim 1, wherein said racket head is disposed in a first plane, said web portion is disposed in a second plane, and said first and second planes have a predetermined angular relationship.

5. The hand grip of claim 1, further including a plurality of finger engaging slots disposed in the radially distal edge portion of said web portion, said plurality of finger engaging slots being spaced longitudinally adjacent to said plurality of finger receiving holes.

6. The hand grip of claims 1 or 5, wherein said tubular member includes textured surface portions disposed to engage frictionally the palm and thumb of a hand gripping said hand grip.

7. The hand grip of claim 5, including a quartet of finger receiving holes and a quartet of finger engaging slots.

8. In a game racket which includes a racket head and a handle extending therefrom; a hand grip comprising a tubular member secured to the distal end of said handle in axial alignment therewith, a rigid web portion extending generally radially from said tubular member and extending longitudinally therealong, a plurality of finger receiving holes extending through said web portion and spaced longitudinally in closely adjacent fashion, at least two of said holes having differing diameters to accommodate the fingers of a hand.

* * * * *